United States Patent [19]

Brown

[11] 4,043,693

[45] Aug. 23, 1977

[54] BRIDGE JOINT SEALS

[75] Inventor: Delmont D. Brown, North Baltimore, Ohio

[73] Assignee: The D. S. Brown Company, North Baltimore, Ohio

[21] Appl. No.: 669,843

[22] Filed: Mar. 24, 1976

Related U.S. Application Data

[60] Continuation of Ser. No. 282,259, Aug. 21, 1972, abandoned, which is a division of Ser. No. 43,317, June 4, 1970, Pat. No. 3,687,022.

[51] Int. Cl.[2] ..... E01C 11/10

[52] U.S. Cl. ..... 404/64; 52/396; 52/403; 49/475

[58] Field of Search ..... 404/64, 65, 66, 67, 404/69; 52/396; 49/475

[56] References Cited

U.S. PATENT DOCUMENTS

| | | | |
|---|---|---|---|
| 3,323,426 | 6/1967 | Hahn | 404/65 X |
| 3,485,149 | 12/1969 | Boney | 404/64 |
| 3,595,141 | 7/1971 | Boney | 404/65 |
| 3,645,176 | 2/1972 | Berchou | 404/64 |

*Primary Examiner*—Nile C. Byers
*Attorney, Agent, or Firm*—Keil, Thompson & Shurtleff

[57] ABSTRACT

Elongated, hollow elastomer seals particularly useful for the sealing of bridge deck joints, bridge approach joints and like wide joints against intrusion by liquids and incompressible solids and embodying a transversely concave top wall; side walls and a bottom wall, and an internal web structure with a pair of webs extending respectively between intermediate portions of the top wall located intermediate the longitudinal midportion thereof and respective side walls and respective intermediate portions of laterally extending internal webs to resist inward rolling of the upper longitudinal corners of the seal away from the joint faces when the seal is seated under lateral compression in a joint.

5 Claims, 1 Drawing Figure

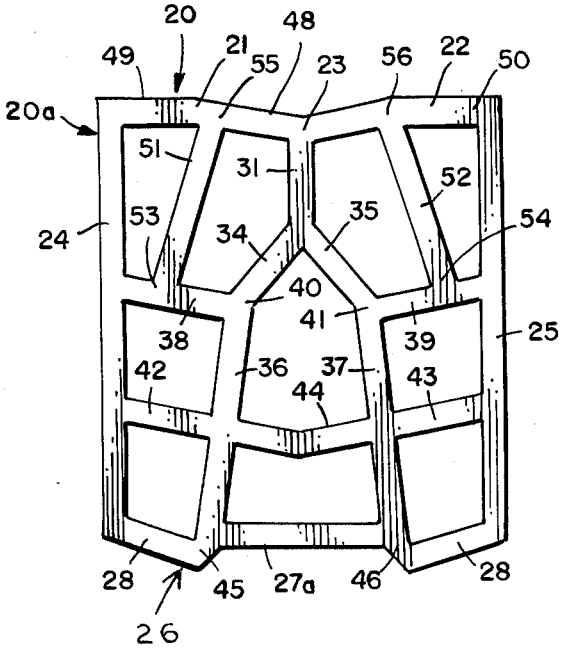
20
48
49
21
55
23
56
22
50
20a
51
31
52
53
35
54
24
34
40
41
38
39
25
42
36
37
43
44
28
45
27a
46
28
26

BRIDGE JOINT SEALS

RELATED APPLICATIONS

This application is a continuation of application Ser. No. 282,259, filed Aug. 21, 1972 now abandoned, which is a division of my copending application Ser. No. 43,317 filed June 4, 1970, now U.S. Pat. No. 3,687,022.

SUMMARY OF THE INVENTION

This invention concerns improvements in elastomer seals in joints in bridge decks, bridge approaches, and like joints having a relatively large amount of movement during expansion and contraction. The subject seals are particularly suited for sealing of bridge deck joints which have a ledge or seat extending longitudinally on respective opposing faces of said joint. One of the novel features of the subject invention is the provision on the bottom wall of the elongated seal of folding foot portions extending longitudinally along respective longitudinal edge portions of the bottom wall. These folding foot portions are adapted to take the shape of longitudinally extending seats when the subject seals are laterally compressed for insertion into a bridge deck joint or the like. The foot portions also coact to substantially eliminate upward movement of the seal in the joint as it opens and closes under changing environmental temperatures.

The primary purpose of sealing bridge deck joints and like joints is to prevent the infiltration of and accumulation of sand, gravel and/or other incompressibles in the joint and thereby preventing the joint from closing on expansion of the bridge deck and/or its supporting structure in warm weather. Another important reason for sealing such joints is to prevent the infiltration of and flow through in bridge deck joints of rain water, or melted snow and/or ice. Water in general, and particularly water carrying dissolved chemicals such as solids to deice or prevent ice on bridge decks, is detrimental to metal and/or concrete understructures of the bridge. Water infiltration through joints on bridge approaches and the respective ends of bridges can also create serious problems such as washing away of soil packed against and supporting end piers and end walls of bridge structures.

Seals of the subject invention are capable of exerting a relatively constant lateral thrust against the side walls of the joint from the 50% collapsed state to about one-fifth (20%) collapse, said percentages being based on the uncollapsed width of the seal. The seals as initially installed preferably should exert at about 20% collapse approximately 4 pounds of thrust per lineal inch of joint. All such seals have a normal width dimension greater than the widest opening expected from the joint over its anticipated movement in the field. When the seal is in its fully collapsed state, it is laterally compressed to the degree that the walls and internal webs lie against each other and preclude further lateral collapse. It is preferable for purposes of best joint design, however, to dimension the seal so that the latter state is approached but not reached when the bridge joint is in its state of maximum closure. When the joint has opened to its widest dimension, it is preferred that the seal be at least 15–20% laterally collapsed, i.e., a collapsed width of about 80–85% of the uncollapsed or normal width of the seal.

The subject elongated, hollow elastomer seals have longitudinally elongated top, bottom and side walls defining a hollow, tubular-like elastomer member adapted to be laterally compressed and inserted in the laterally compressed state into joints of the character above described. The lateral or outward web of the side walls of the seal against the side walls of the joint is increased by an elastomer internal web structure functioning in coaction with the top, bottom and side walls to provide lines of increased localized thrust along at least the upper and lower edges of the side walls against the side walls of the joint.

The internal web structure of the subject seals comprises a pair of elongated, downwardly diverging webs in the transversely median portion of the seal as viewed in end elevation or transverse cross section. These diverging webs may be joined directly at their apex with the longitudinal midportion of the top wall. More preferably, however, they are connected at their apex with said longitudinal midportion of the top wall by a vertical, narrow web substantially midway between the side walls. The lower longitudinal edges of the diverging webs are joined with the bottom wall. Additional webs of the internal web structure include webs extending substantially transversely laterally between the aforesaid median portion of the internal structure and respective side walls of the seal. Such webs preferably have an outward and upward slope in the transverse direction and are joined at their inner longitudinal edges with the aforesaid downwardly diverging webs. In some embodiments of the invention, the internal structure also includes one or more additional webs extending laterally between the diverging webs which additional webs may be substantially planar, horizontal webs or may have a shallow V-configuration as viewed in end elevation or transverse cross section.

The top wall of the seals herein may be substantially flat but more preferably has a shallow V-configuration at least along the longitudinal midportion thereof. If desired, the entire top wall may have a shallow V-configuration. Furthermore for purposes of effecting a better seal of the upper, longitudinal edges of the side walls with the side walls of the joint, these upper longitudinal edges may have a small, laterally projecting, preferably substantially sharp-edged lip, each of which provides a relatively sharp longitudinal line of localized lateral thrust against the side walls of the joint along the respective upper corners of the seal. The sealing at the upper, longitudinal edges further may be enhanced by an additional pair of diagonally downwardly and outwardly sloping webs extending respectively between intermediate portions of the top wall and intermediate portions of the uppermost pair of laterally extending webs. This pair of diagonal webs resist downward movement of the intermediate portions of the top wall by "pushing" upwardly on intermediate segments of the top wall when the seal is collapsed laterally and thereby keeps the upper, longitudinal corners from "rolling" inwardly. The concave, V- or U-fold in the top wall occurs essentially in the center segment. The webs retain their essentially straight configuration when the seal is collapsed laterally and thereby keep the outer top wall segments in a substantially horizontal or slightly upwardly bowed configuration. The bottom wall comprises a longitudinal midportion and the aforesaid foot-forming longitudinal edge portions on each side thereof. The longitudinal midportion of the bottom wall may be substantially flat or planar or it may have a V-shape, preferably a shallow V-shape, as viewed in end elevation or transverse cross section. The lower longitudinal edges of said diverging webs preferably are connected to the bottom wall at the longitudinally extending junctures of the longitudinal midportion and the foot-forming edge portions of the bottom wall.

By virtue of the connection of the bottom wall with a longitudinal midportion of the top wall via the aforesaid internal web structure, the elastic recovery forces developed upon bending the bottom wall and the other internal web members creates an upward thrust therein. This upward thrust is transmitted through the internal structure of the seal with the result that elastic recovery forces in the bottom wall push the center portion of the top wall upwardly and thus augment the aforesaid anti-rolling effect provided by the downwardly and outwardly diagonal webs at respective upper corners of the sealing strip.

DESCRIPTION OF THE DRAWINGS

A preferred embodiment of the invention is illustrated in the drawing, wherein the FIGURE is a front elevation of a bridge seal with the aforesaid internal web configuration.

DESCRIPTION OF THE ILLUSTRATED EMBODIMENT

The bridge seal 20*a* has a top wall 20 of shallow, trough-like configuration with a central junction or nadir 23 between elongated, substantially symmetrical segments 21 and 22, which are joined to the upper edges of side walls 24 and 25.

The side walls 24 and 25 are elongated, elastomer substantially flat or planar walls having a vertical orientation. Minor traverse curvatures, such as result from extrusion variations from the substantially flat or planar form, are not objectionable. The bottom wall 26 completes the hollow shell formed by the outer walls of the elastomer seal 10. The bottom wall 26 is composed of an elongated, elastomer center segment 27*a* which may be substantially planar, but which preferably has a shallow trough-like configuration in end elevation or transverse cross section, e.g., a very shallow V or U configuration. The latter configurations are preferred over the substantially flat or planar configuration in order to urge the center segment 27*a* to assume a downwardly directed V-shaped orientation as the seal approaches the full state of lateral collapse in the joint. It is contemplated, however, that the center section 27*a* and/or the later described cross web 44 may assume an inverted V-configuration as the seal approaches the state of full lateral collapse in the joint.

The top wall of seal 20*a* is composed of a shallow V-shaped, medial segment 48 and substantially horizontal, edge segments 49 and 50. A pair of diagonally outwardly and downwardly sloping webs 51 and 52 extend respectively between intermediate portions 55 and 56 of the top wall, i.e., the lines of juncture of medial segment 48 and edge segments 49 and 50, and intermediate portions 53 and 54 of the legs or webs 38 and 39. The intersections of webs 51 and 52 with the legs or webs 38 and 39 are preferably spaced from the side walls 24 and 25 and closer to the side walls than to the junctures 41 and 40 of legs or webs 38 and 39 with the diverging webs 34, 36 and 35, 37, e.g., a spacing ratio in the order of 1:3 to 4.

The top wall tends to fold progressively closer to the webs 38 and 39 as lateral collapse of the seal progresses. There is a tendency for the upper longitudinal corners of the seal to "roll" inwardly away from the joint faces. The diagonal webs 51 and 52 resist the aforesaid tendency of the top wall to approach the webs 38 and 39 and thus exert a rotational moment on the upper corner portions of the seal in directions opposite to the respective "roll" tendencies — thereby keeping the upper longitudinal edges of the side walls pressed tightly against the joint faces.

In any of the forms of the invention herein, the seals should be made of good quality elastomer formulations in order that these seals retain their elastic properties with aging under environmental conditions. To this end, the elastomer composition should be an elastomer formulation which is extrudable, and which, upon vulcanization, will be resistant to deterioration and/or loss of resilience after exposure to hot and cold weather conditions, sunlight, and like elements of nature in the use thereof in joints of pavement, air strips, and the like. Care should be exercised in selecting an elastomer formulation whereby the seal will retain its flexibility and elastic recovery force generation at the coldest temperatures to be encountered in the field. The presently best-known elastomer is neoprene: particularly the crystallization-resistant types thereof.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the form herein disclosed being a preferred embodiment for the purpose of illustrating the invention.

The invention is hereby claimed as follows:

1. A hollow, elongated elastomer seal useful for sealing pavement joints and bridge joints comprising an elongated, elastomer top wall; an elongated, substantially planar or shallow V-shaped, elastomer bottom wall; elongated, elastomer side walls joined at their longitudinal edges with said top and bottom walls; said top wall having a concave medial segment and substantially horizontal edge segments; and an internal, elastomer web structure characterized by a pair of transversely downwardly diverging, elongated, elastomer webs having their apex substantially vertically aligned with the longitudinal midportion of said bottom wall, means joining said apex with the longitudinal midportion of said top wall; a pair of transversely laterally extending, elongated elastomer webs joined at their longitudinal edges respectively with one of said diverging webs near said apex and one of said side walls; and an additional pair of webs extending respectively diagonally outwardly and downwardly between (a) intermediate portions of said top wall at the respective lines of juncture of said medial segment and said edge segments and (b) respective intermediate portions of said laterally extending internal webs with the respective intersections of said additional webs and said respective laterally extending internal webs being closer to the respective side walls than to the respective junctures of said last-mentioned internal webs and said diverging webs, the spacing ratio of the respective intersections of said additional webs and said intermediate portions, relative to said side walls and to said diverging webs, being in the range of 1:3 and 1:4, whereby the web structure and orientation of said webs provide resistance to inward rolling of the upper longitudinal corners of the seal away from the joint faces when the seal is seated under lateral compression in a joint, the bottom wall of said seal comprising a longitudinal midportion connected to the lower longitudinal edges of said side walls by elongated, respective V-shaped foot portions adapted to fold into substantially V-shaped transverse cross section when said seal is collapsed laterally, said foot portions respectively being composed of a first segment sloping downwardly from the respective lower longitudinal edges of said side walls and a second segment of more acute downward slope extending downwardly from the respective longitudinal edges of said longitudinal midportions.

2. An elastomer seal as claimed in claim 1, wherein said diverging webs are joined at their apex with the longitudinal midportion of said top wall by an elongated, vertical, elastomer web substantially midway between said side walls and having its longitudinal edges respectively joined with said apex and said longitudinal midportion of said top wall.

3. An elastomer seal as claimed in claim 1, wherein the bottom wall of said seal comprises a longitudinal midportion connected to the lower longitudinal edges of said side walls by elongated, respective V-shaped foot portions adapted to fold into substantially V-shaped transverse cross section when said seal is collapsed laterally, said foot portions respectively being composed of a first segment sloping downwardly from the respective lower longitudinal edges of said side walls and a second segment of more acute downward slope extending downwardly from the respective longitudinal edges of said longitudinal midportions.

4. An elastomer seal as claimed in claim 1, wherein said pair of downwardly diverging elongated, elastomer webs respectively are connected at their lower edges to the longitudinal juncture of said longitudinal midportion and said foot portions.

5. In a hollow, elongated elastomer seal useful for sealing pavement joints and bridge joints comprising an elongated, elastomer top wall; an elongated, elastomer bottom wall; elongated, elastomer side walls joined at their longitudinal edges with said top and bottom walls; and an internal, elastomer web structure, the improvement which comprises transversely laterally extending, elongated elastomer web members connecting said internal web structure with respective side walls; said top wall having a concave medial segment and substantially horizontal edge segments; and additional, elongated, elastomer webs extending respectively diagonally downwardly and outwardly between said web members and said top wall and joined with said top wall at the respective lines of juncture of said medial segment and said edge segments of said top wall and to said laterally extending web members at a point spaced from the respective side wall with the respective intersections of said additional web members and said respective laterally extending internal web members being closer to the respective side walls than to the respective junctures of said last-mentioned internal web members and said internal web structure, the spacing ratio of the respective intersections of said additional webs and said laterally extending web members, relative to said side walls and to said internal web structure, being in the range of 1:3 to 1:4, whereby the web structure and orientation of said webs and said web members provide resistance to inward rolling of the upper longitudinal corners of the seal away from the joint faces when the seal is seated under lateral compression in a joint, and the bottom wall of said seal comprising a longitudinal midportion connected to the lower longitudinal edges of said side walls by longitudinal, downwardly extending, substantially V-shaped, shallow foot portions.

* * * * *